US008689684B2

(12) United States Patent
Haberstroh et al.

(10) Patent No.: US 8,689,684 B2
(45) Date of Patent: Apr. 8, 2014

(54) AUTOMATIC STRAP LOADING ASSEMBLY FOR STRAPPING MACHINE

(71) Applicants: James A. Haberstroh, Vernon Hills, IL (US); Andrew J. Nyckowski, Palatine, IL (US)

(72) Inventors: James A. Haberstroh, Vernon Hills, IL (US); Andrew J. Nyckowski, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/623,285

(22) Filed: Sep. 20, 2012

(65) Prior Publication Data

US 2013/0098252 A1 Apr. 25, 2013

Related U.S. Application Data

(60) Provisional application No. 61/549,030, filed on Oct. 19, 2011.

(51) Int. Cl.
*B65B 13/18* (2006.01)

(52) U.S. Cl.
CPC ..... *B65B 13/18* (2013.01); *B65B 13/184* (2013.01)
USPC ..... 100/29; 100/26; 100/32

(58) Field of Classification Search
USPC ..... 100/26, 29, 32, 34; 53/589
See application file for complete search history.

(56) References Cited

U.S. PATENT DOCUMENTS

| | | | | |
|---|---|---|---|---|
| 5,459,977 | A | 10/1995 | Haberstroh | |
| 7,121,194 | B2 * | 10/2006 | Pearson et al. | 100/32 |
| 7,287,464 | B1 * | 10/2007 | Kirar et al. | 100/26 |
| 7,395,754 | B1 * | 7/2008 | Bobren et al. | 100/26 |
| 7,677,168 | B1 * | 3/2010 | Liu et al. | 100/26 |
| 2009/0223388 | A1 | 9/2009 | Doyle | |

FOREIGN PATENT DOCUMENTS

| | | | |
|---|---|---|---|
| DE | 9412338 | U1 | 10/1994 |
| EP | 1167198 | A2 | 1/2002 |

OTHER PUBLICATIONS

International Search Report for PCT/US2012/060546, dated Feb. 13, 2013.

* cited by examiner

*Primary Examiner* — Jimmy T Nguyen
(74) *Attorney, Agent, or Firm* — Levenfeld Pearlstein, LLC

(57) ABSTRACT

A strap loading assembly for a strapping machine provides a feed path for the strap material. The loading assembly includes a first rail and a second rail movable between a deployed position and a stowed position. The second rail, when in the deployed position, confronts the first rail and defines a strap guide with the first rail. The second rail, when in the stowed position opens the strap guide. A link operably connects the first and second rails. Strap material in the strap guide, when in tension, exerts a force on the first rail to move the link which moves the second rail from the deployed position to the stowed position. A strapping machine with a strap loading assembly is also disclosed.

19 Claims, 7 Drawing Sheets

AUTOMATIC STRAP LOADING ASSEMBLY FOR STRAPPING MACHINE

CROSS-REFERENCE TO RELATED APPLICATION DATA

This application claims the benefit of priority of Provisional U.S. Patent Application Ser. No. 61/549,030, filed Oct. 19, 2011, the disclosure of which is incorporated by reference in its entirety.

BACKGROUND

Strapping machines are known for securing straps around loads. In one arrangement, during the strapping cycle, strap material is fed from a dispenser into a strapping machine. The strap is fed through a slack box, through a feed head and sealing head and into a strap chute. The strap is conveyed through the strap chute and back to the sealing head.

Once the strap returns to the sealing head, the lead end is gripped in a gripper, and the strap is pulled from the strap chute onto the load in a take-up portion of the cycle. The strap is then tensioned, in a tension portion of the cycle, and overlapping course of strap material are sealed to one another, as by welding, to form the strap joint. The strap is then severed downstream of the strap joint and the load removed hum the strapping machine. A subsequent lead end is then ready to be pushed through the strap chute to strap the next load.

In the take-up and tension portions of the cycle, the strap that is taken up or retracted from the strap chute must be stored within the strapping machine—in the slack box. This serves a number of functions. First, it provides storage for the strap that is taken up from around the load. Given the size and weight of the strap reel, and the inertia produced when the reel rotates to dispense strap, it would be impractical to rewind the taken-up strap onto the reel. The slack box thus provides a location to store this taken-up strap.

The slack box also provides for a quantity of strap material to be used for a subsequent strapping cycle, whether it is for a subsequent load or for an additional band around an already strapped load. Again, due to the force required to commence rotation of the reel, the inertia produced, and the slow start to rotation of the reel, the slack box provides a quantity of strap that can be fed on-demand, almost instantaneously, without having to bring the rotating reel up to speed in a short period of time.

However, with this arrangement, there must still be a physical path from the feed to the slack box (from the infeed to the slack box) to the outlet of the slack box (to the feed head), for example when initially feeding strap or after a misfeed. The physical path must, however, be movable so that once the strap extends through the slack box (from the infeed to the outlet), the path can be moved out of the way to prevent interfering with slack strap that is fed into, and drawn from, the box.

Accordingly, there is a need for a device that provides a strap guide for automatic strap feed into the strapping machine, from the strap supply to the feed head. Desirably, such a guide moves or a portion is moved from the strap path to permit strap to fill into the slack box. More desirably still, such a guide or guide portion automatically moves out of the strap path, without the strap having to "push" the guide portion, once the strap extends from the inlet to the outlet or feed head to establish the strap path.

SUMMARY

An automatic strap loading assembly provides a feed path for feeding strap material into the strapping machine. The strap loading assembly is for use in a strapping machine that feeds a strapping material around a load, positions, tensions and seals the strapping material around the load.

The strapping, machine includes a feed head for feeding the strapping material into the strapping, machine, a strap chute through which the strapping material is conveyed and a sealing head to seal overlapping courses of the strapping material to one another. The feed head has a driven feed wheel and a pinch feed wheel.

The strapping machine further includes a strap pre-feed assembly having a driven infeed wheel and a pinch infeed wheel. A slack box is positioned between the strap pre-feed and the feed head.

The strap loading assembly is positioned at least in part in the slack box, between the pre-feed assembly and the feed head. The strap loading, assembly includes a first rail and a second rail. The second rail is movable between a deployed position and a stowed position. The second rail, when in the deployed position, confronts the first rail and defines a strap guide with the first rail through the slack box. The second rail, when in the stowed position opens the strap guide to the slack box.

A link operably connects the first and second rails. Strap material in the strap guide, when in tension, exerts a force on the first rail to move the link which moves the second rail from the deployed position to the stowed position.

In an embodiment, the first rail is pivotable between a deployed position and an actuating position to move the second rail from the deployed position to the stowed position. The second rail is also pivotally movable between the deployed and stowed positions. The second rail can pivot about two pivot pins at opposing ends of the rail. A spring can operably connect the second rail to maintain the second rail in one or both of the deployed and stowed positions.

A stop can limit movement of the first rail to the actuating position. A stop can also limit movement of the first rail to the deployed position.

The link connecting the rails can include a first finger that cooperates with a second finger mounted to the second rail to pivotally move the second rail from the deployed position to the stowed position.

A reset link can move the second link from the stowed position to the deployed position. The reset link includes a handle to manually reset the second rail front the stowed position to the deployed position.

A strapping, machine includes a feed head for feeding strapping material into the strapping machine and a strap chute through which the strapping material is conveyed. A sealing head seals overlapping courses of the strapping material to one another. The machine further includes a strap pre-feed assembly and a slack box positioned between the strap pre-feed assembly and the feed head.

A strap loading assembly is positioned at least in part in the slack box, between the pre-feed assembly and the feed head. The strap loading assembly includes first and second rails. The second rail is movable between a deployed position and a stowed position. The second rail, when in the deployed position, confronts the first rail and defines a strap guide with the first rail. The second rail, when in the stowed position opens the strap guide to the slack box.

A link operably connects the first and second rails. Strap material in the strap guide, when in tension, exerts a force on the first rail to move the link, which moves the second rail from the deployed position to the stowed position.

The link is mounted to the first rail and the first rail is pivotable between a deployed position and an actuating position. The link operably connects to the second rail to move the second rail from the deployed position to the stowed position.

The second rail can be pivotally movable between the deployed and stowed positions. The link can be operably connected to the second rail by a pair of fingers, a first finger mounted to the link and a second finger mounted to the second rail.

A reset link can move the second link from the stowed position to the deployed position. Stops can limit movement of the first rail to the actuating position and to the deployed position.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
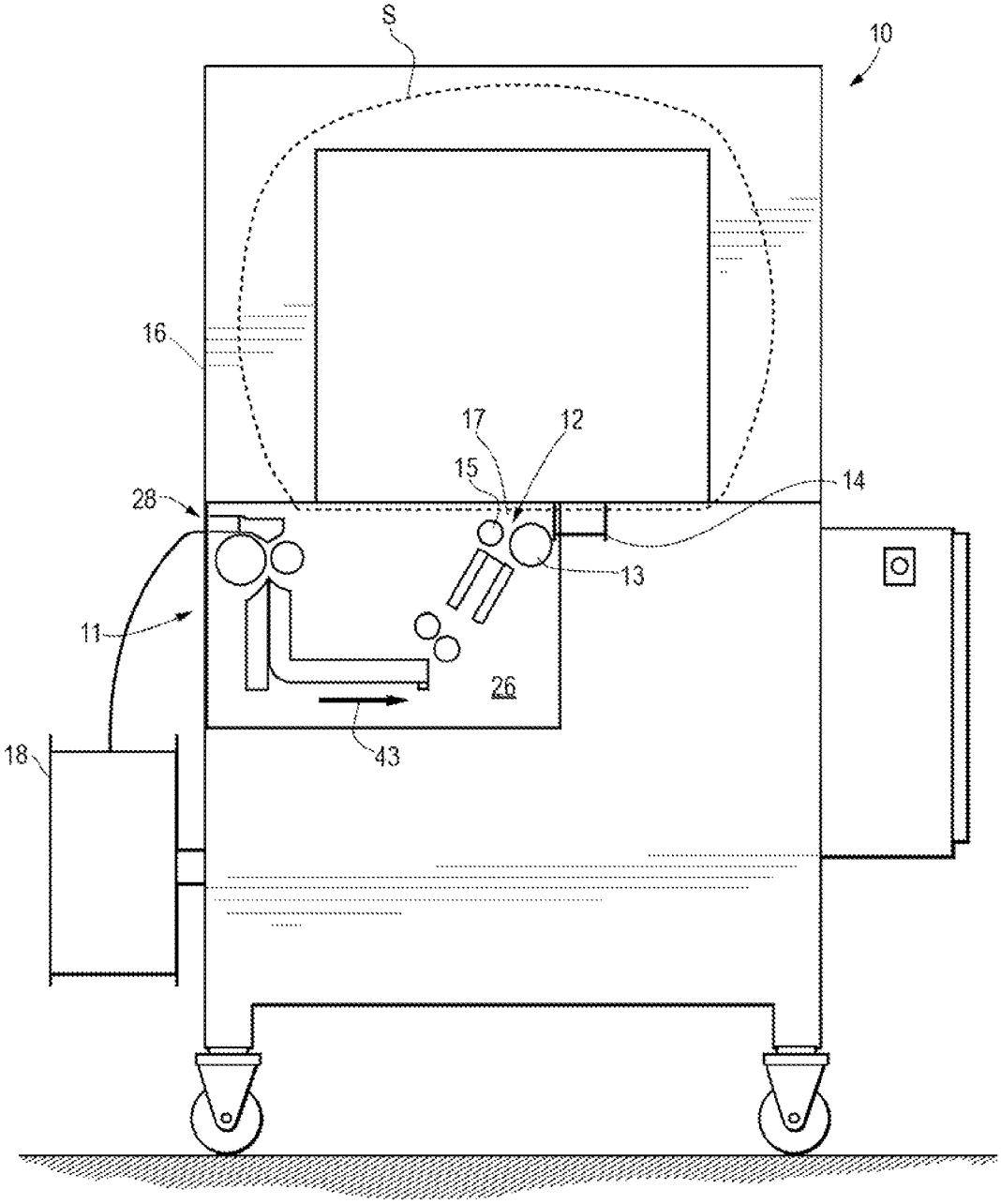
FIG. 1 illustrates a general layout of an exemplary strapping machine.

Referring to the figures and in particular to FIG. 1 there is shown an exemplary strapping machine 10. The strapping machine 10 includes, generally, a feed head 12, a sealing head 14, a strap chute 16 and a strap supply 18, such as the illustrated strap dispenser. A typical feed head 12 includes a driven feed wheel 13 and a pinch feed wheel 15 that form a nip 17 through which the strap S is conveyed toward the sealing head 14 and into the strap chute 16.

The strapping machine 10 also includes a pre-feed assembly 28 that is disposed at about the inlet (indicated generally at 19) of the strapping machine 10, to draw strap from the dispenser 18. A slack box 26 is positioned between the pre-feed assembly 28 and the feed head 12. A strap loading, assembly, illustrated generally at 11, is positioned downstream of the pre-feed assembly 28, at least in part within the slack box 26, and provides a strap path from pre-feed assembly 28 to the feed head 12.

The pre-feed assembly 28 extends from the inlet 19 to a pair of infeed wheels 20 and 22. One of the infeed wheels 20 is driven by a motor 21; the other infeed wheel 22 is an idler, pinch wheel. A nip 24 is defined between the inked wheels 20 and 22.

The strap loading assembly 11 includes a strap guide 32 that extends from about the pre-feed assembly 28 toward the feed head 12 to provide a conveyance path for the strap S to the feed head 12. The guide 32 is positioned, at least in part, in the slack box 26 and defines a physical track through the slack box 26, through which the strap S is conveyed. The guide 32 includes a substantially straight section 34 and a turn 36 that directs the strap S toward the feed head 12.

Figure 2:
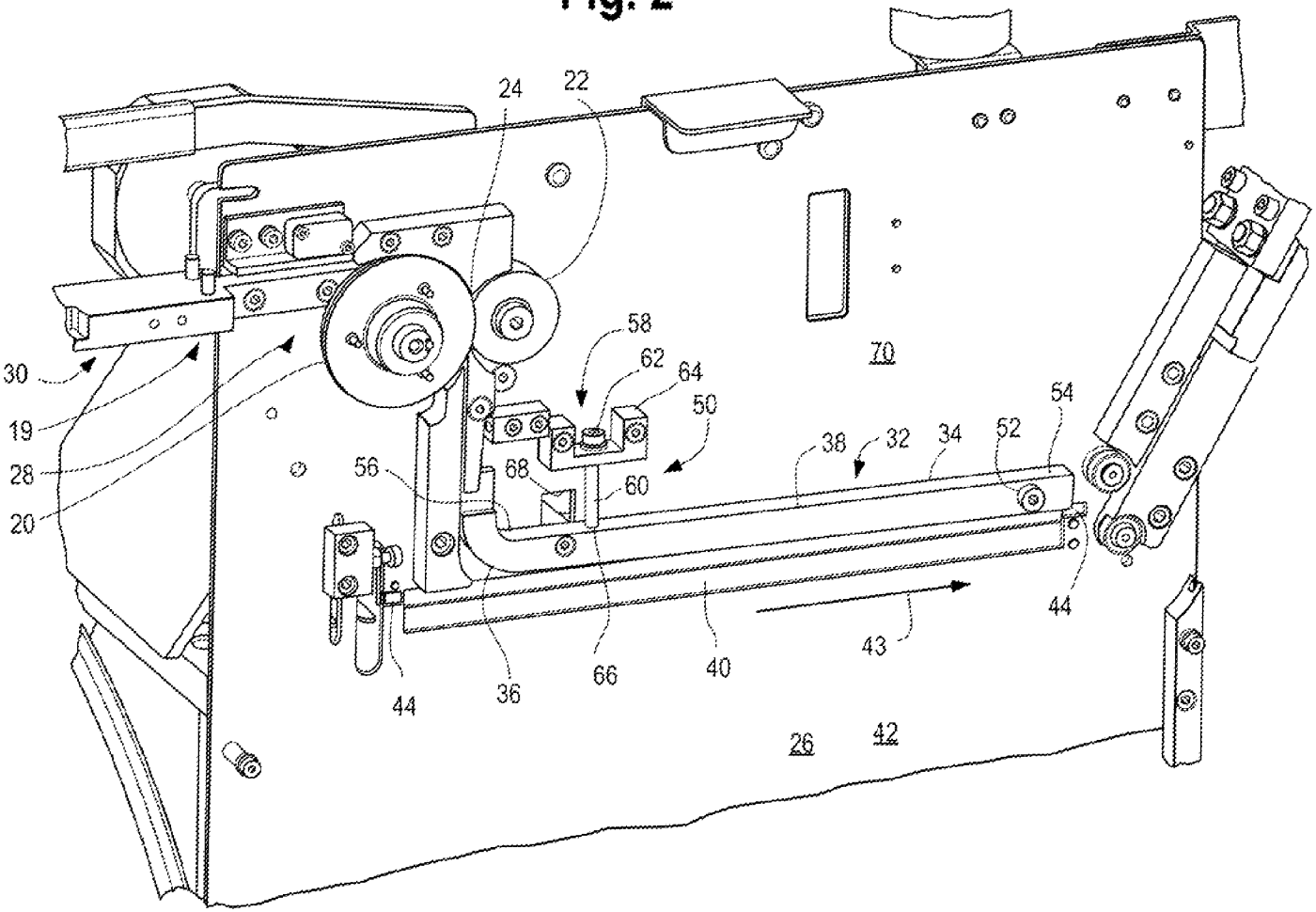
FIG. 2 is a front perspective illustration of an automatic strap feed assembly within a slack box of the strapping machine, the strap guide lower rail being shown in the stowed position.
Figure 3:
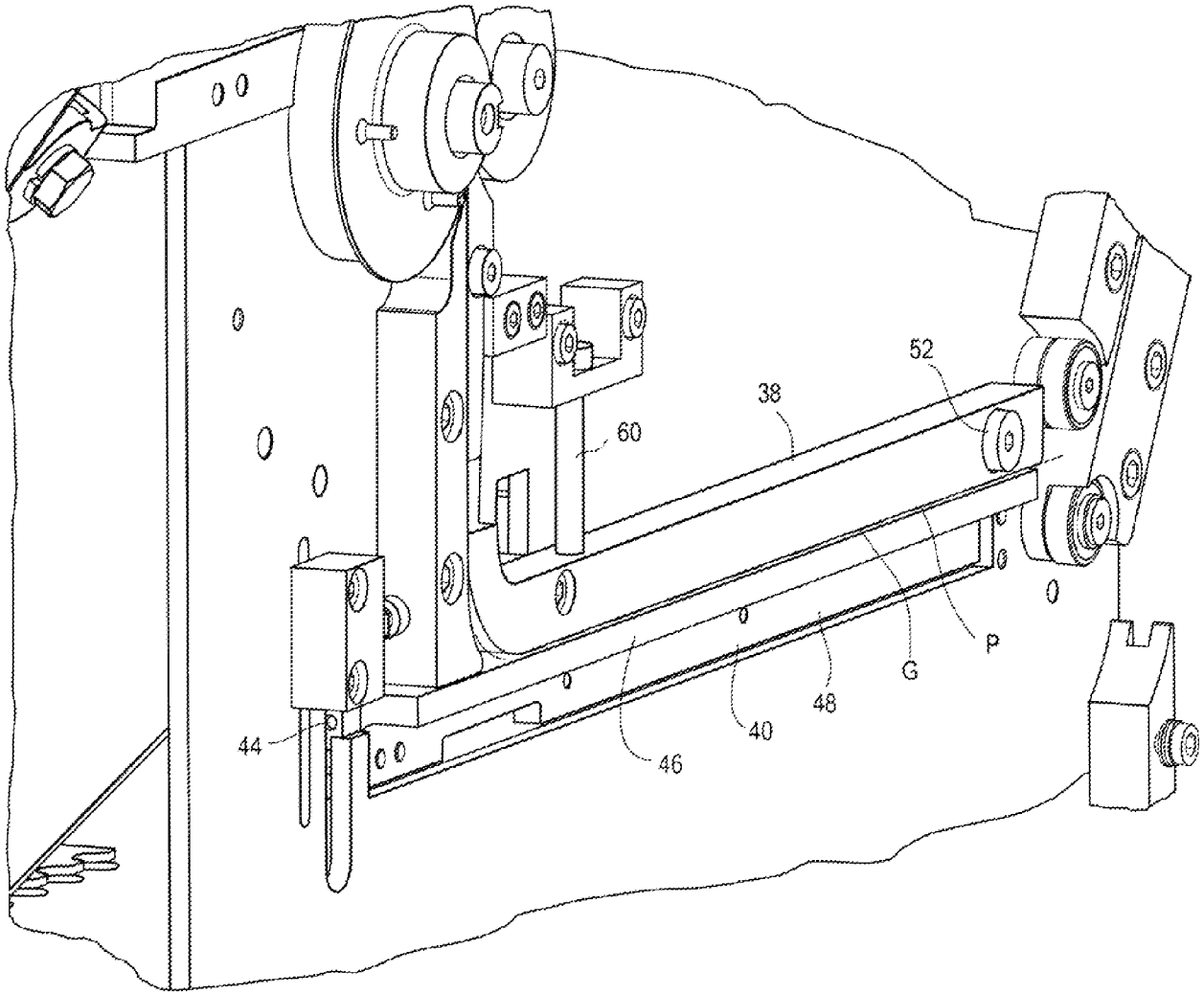
FIG. 3 is an enlarged front perspective illustration similar to FIG. 2 shown with the lower rail in the deployed position.

As seen in FIG. 3, the strap guide 32, when in the deployed (or feed) position, provides a direct conveyance path from the inked 30 to the feed head 12. The guide 32 includes an upper rail 38 and a lower rail 40 that define, in part, the strap path P. The lower rail 40 separates the strap path P from the accumulation region 42 in the slack box 26. During the strapping operation, strap S is conveyed (or pushed) through the machine 10 in the feed direction, indicated by the arrow at 43 in FIG. 2.

The lower rail 40 is mounted to the strapping, machine 10 to pivot about a pair of pivot pins 44. The lower rail 40 pivots between a deployed position, as seen in FIG. 3 and a stowed position as seen in FIG. 2. In the deployed position the lower rail 40 confront the upper rail 38 and establishes the strap path P. In the stowed position the lower guide 40 pivots away and the strap path P opens to the slack box accumulation region 42. The lower rail 40 is formed as an angled section. One leg 46 of the angle forms the guide portion of the lower rail 40. The other leg 48 is a rearwardly extending flange.

In known systems, opening of the guide to the slack box is accomplished by, for example, the fed strap "pushing" on the rail to move the guide to open the strap path to the slack box. However, as strap thickness is reduced (to reduce material and thus cost) the stiffness of the strap is also reduced. As a result, the column stiffness of the strap S may not be sufficient to push the guide open.

In the illustrated automatic strap loading assembly 11, the lower rail 40 is moved or pivoted as a result of tension being drawn in the strap S, rather than the strap "pushing" to open the guide. Accordingly, the upper rail 38 is configured to pivot a small amount upwardly, from the deployed position to the actuating position, about a pivot axis as indicated at 52. In that the pivot 52 is at the downstream end 54 of the upper rail 38, the upstream end 56 travels a greater distance when the rail 38 is pivoted.

The upper rail 38 includes a lower stop 58 to prevent the upper rail 38 from closing too fir down onto the lower rail 40 to thus assure that the gap G in the guide 32 (the distance between the upper and lower rails 38, 40) is maintained a minimum desired distance for strap conveyance. In the illustrated embodiment, the lower stop 58 is a stud or bolt 60 with a head 62 that is engaged with a carriage 64. An opposing end 66 of the stud 60 is fastened to the upper rail 38. Contact of the head 62 with the carriage 64 stops the downward movement of the upper rail 38 (to maintain the gap G). Upward movement of upper rail 38 is limited by the opening 68 in a wall 70 of the machine 10 through which the arm link 72 extends.

The link 72 is operably connected to the lower rail 40. In the illustrated embodiment, the link 72 includes an arm 74 that extends from a rear of the upper rail 38 through the opening 68 in the wall 70 of the strapping machine 10. Referring to FIGS. 4-7, the arm 74 has an angled portion 76 extending downwardly to reside at a rear of the lower rail 40. A first finger or stud 78 is mounted to the arm angled portion 76 and extends transversely from a side of the angled portion 76.

A second finger or stud 80 is mounted to lower rail flange leg 48 and is configured to cooperate with the first finger 78. The second finger 80 extends transverse to the first finger 78 so that the two fingers 78, 80 cross one another when the lower rail 40 is in the deployed state. The first finger 78 is positioned below the second finger 80 when the lower rail 40 is in the deployed state.

Figure 4:
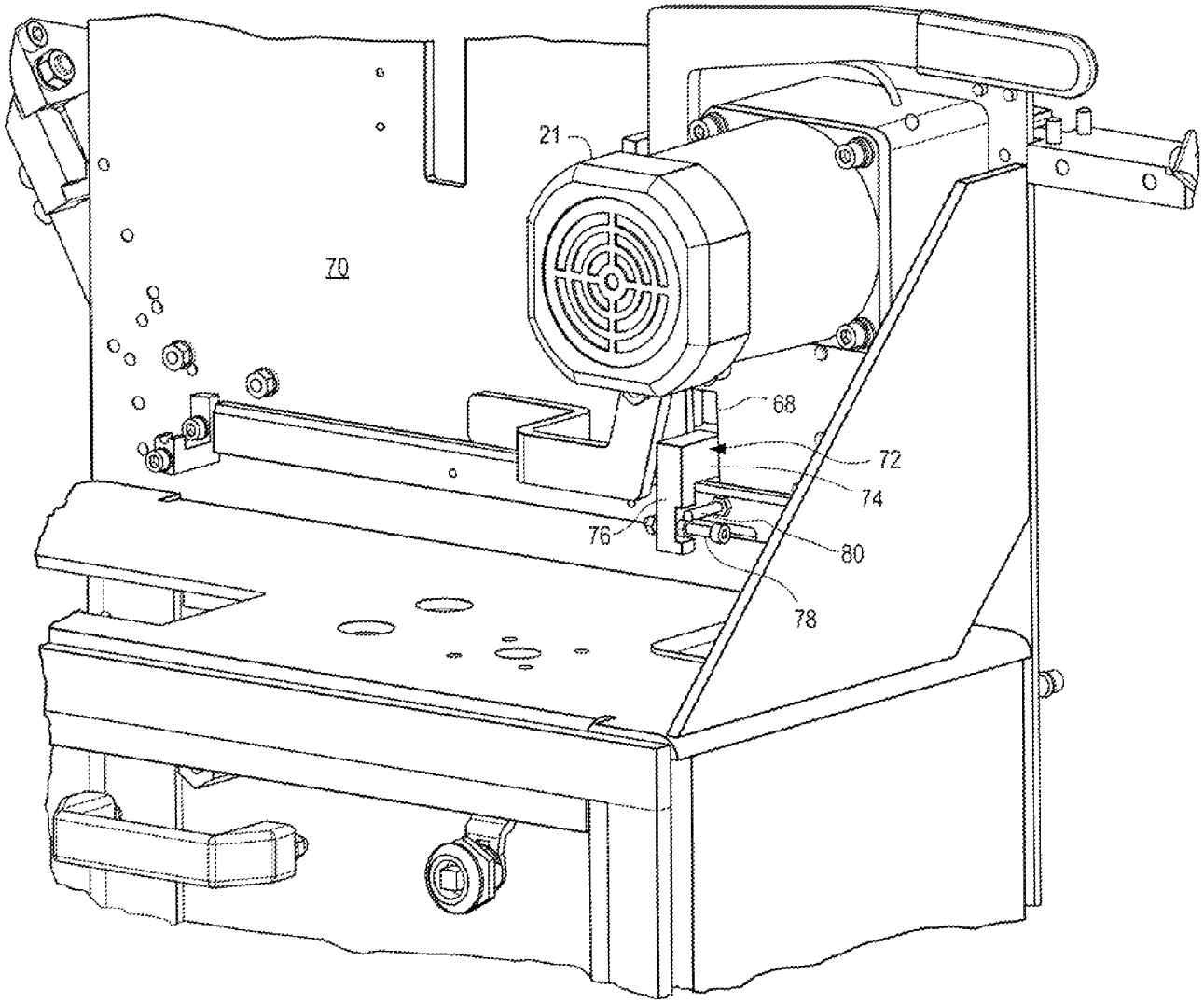
FIG. 4 is rear perspective illustration showing the lower rail in the deployed position.
Figure 5:
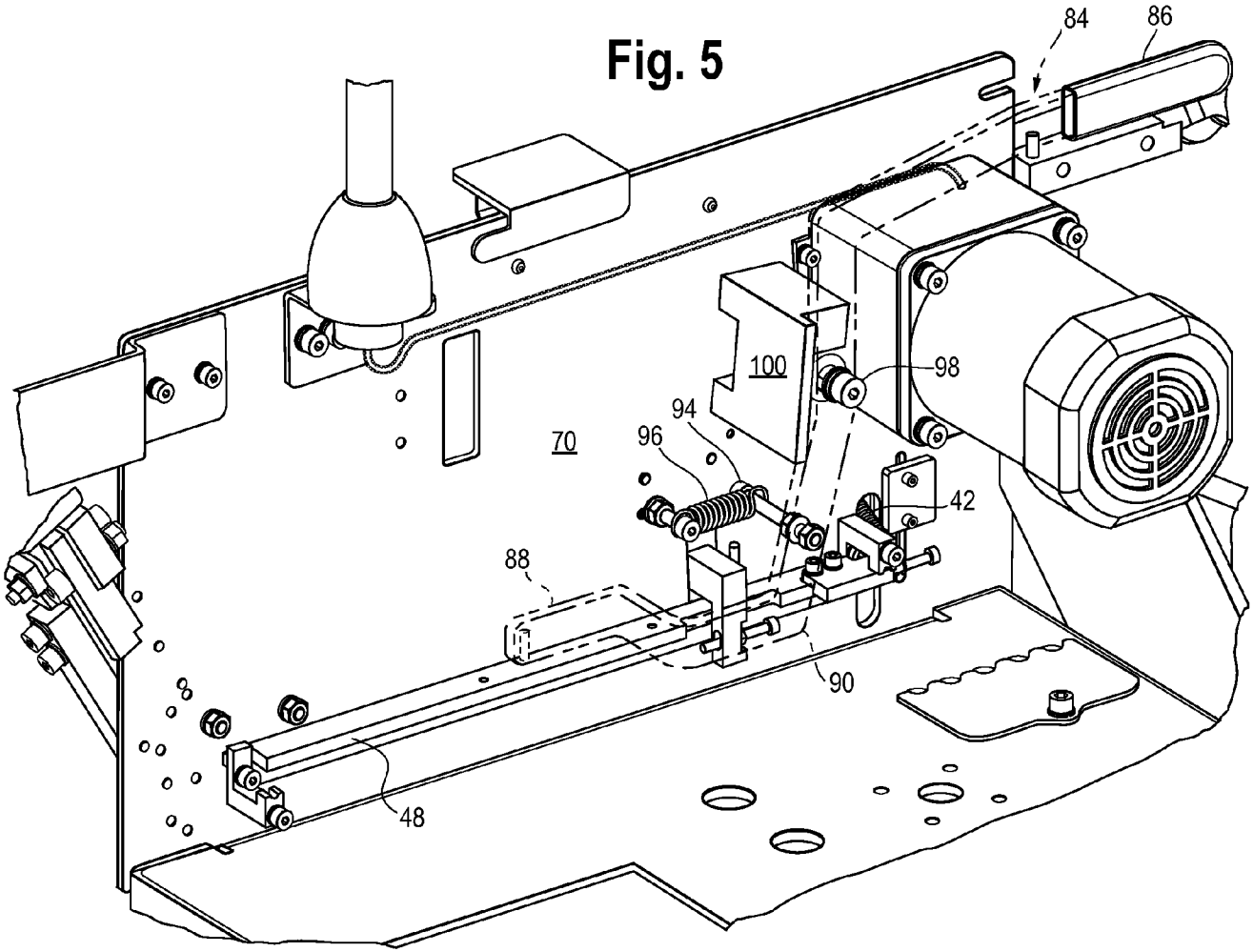
FIG. 5 is another rear perspective illustration showing the lower rail in the stowed position and shown with reset arm in a shadowed view for ease of illustration and viewing.
Figure 6:
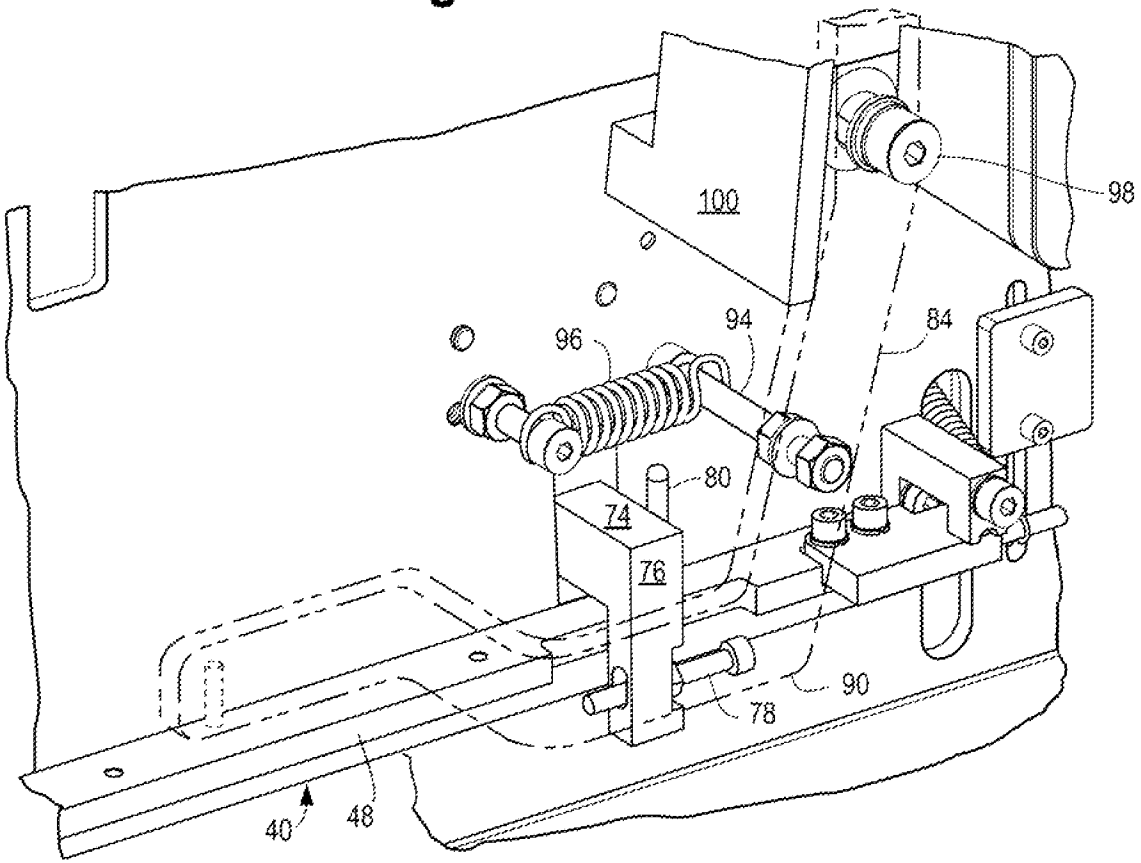
FIG. 6 is an enlarged rear perspective illustration similar to FIG. 5.
Figure 7:
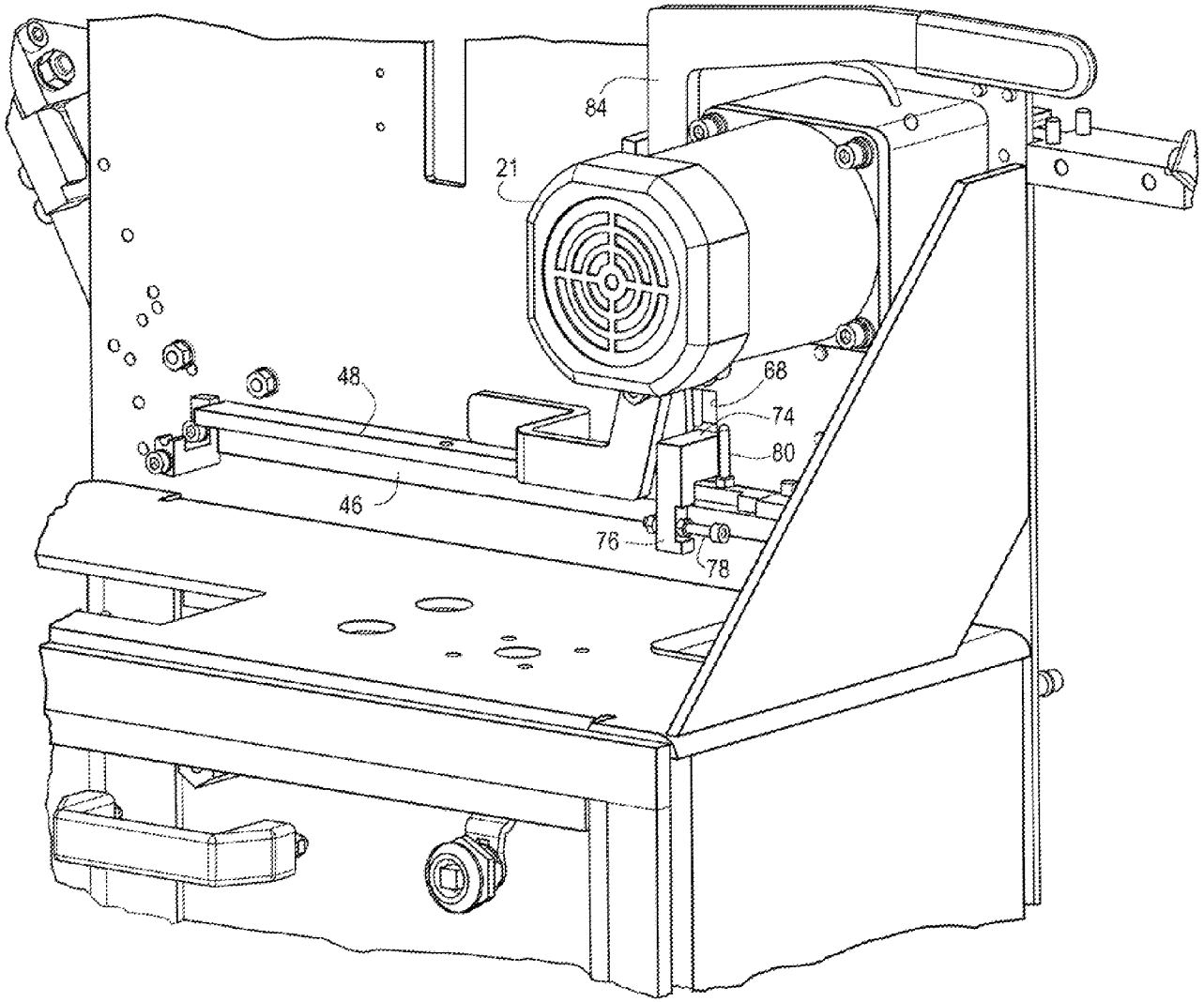
FIG. 7 is another rear perspective view showing the lower rail in the stowed position.

Referring to FIG. 4, the rear view of the lower rail. 40 is shown in the deployed state. The second finger 80, which is mounted to the lower rail flange leg 48, is positioned above and extending transverse to the first finger 78. Now, as seen in FIG. 7, the upper rail 38 has been pivoted upwardly, which in turn moves the arm 74 (which is mounted to the rail 38) upwardly. As the first finger 78 moves up, it contacts the second finger 80 to pivot the lower rail 40. This changes the position of the lower rail 40 from the deployed position to the stowed position. A spring 82 is operably connected to the lower rail 40 to maintain the lower rail 40 in both the deployed and stowed positions (the point of greatest extension of the spring 82 is as the lower rail pivots between the deployed and stowed positions and as such, the spring 82 will maintain the rail 40 in both positions once the rail 40 has passed the point of greatest extension).

The strap loading assembly 11 also includes a reset link or arm 84. The reset arm 84 is operably engageable with the lower rail 40 to physically move and reset the lower rail 40 from the stowed position to the deployed position (for example, during strap S feed). The reset arm 84 includes a handle 86 (for grasping by an operator), and a contact end 88. The contact end 88 is configured to contact the lower rail flange leg 48 when the lower rail 40 is in the stowed position and urge (pivot) the rail 40 to the deployed position.

The reset arm 84 includes an intermediate portion 90, between the handle 86 and contact end 88 that is operably pivotally mounted to a portion or wall 70 within the strapping machine 10. The arm 84 pivots between a reset position (urged or pulled up) and an operating position (urged downward), which is out of the way of the lower rail 40 when the strapping machine 10 is in normal operation. In the illustrated embodiment, the arm 84 is mounted to a pivot stud 94, which is mounted to the wall 70 through which the link arm 74 extends. A spring 96 is operably mounted to the arm 84 and the machine 10 to maintain the arm 84 in the operating position.

In addition to resetting the lower rail 40 to the deployed position, the reset arm 84 is also operably connected to the infeed pinch wheel 22. In the illustrated embodiment, the arm 84 is mounted to a shaft 98 on which the pinch wheel 22 is mounted. The shaft 98 is mounted to the wheel 22 by a bracket 100 to the reset arm 84, spaced from the pivot stud 94. In this manner, as the reset arm 84 is moved to reset the lower rail 40, the pinch wheel shaft 98 is also physically moved away from the driven infeed wheel 20 which establishes a space (larger than the nip 24), between the driven 20 and pinch 22 infeed wheels. As is discussed in more detail below, this space permits feeding strap S through the pre-feed assembly 28 and guide 32, to the feed head 12.

In operation, in strap feed mode there is no strap S in the strapping machine 10; rather, strap S must be fed into the machine 10. With the lower rail 40 in the stowed position, an operator pulls the reset arm handle 86 upward which moves the contact end 88 into contact with the lower rail flange 48 to pivot the lower rail 40 into the deployed position, thus closing the strap guide 32. At the same time, the pinch wheel 22 is moved away from the driven wheel 20.

Strap S is fed into the strapping machine 10 at the inlet to the pre-feed assembly 28, and, because the pinch wheel 22 is moved out of contact with the driven wheel 20, the strap S can be conveyed beyond the inked wheels 20, 22, and into the guide 32 to the feed head 12.

When the handle 86 is released, the spring 96 returns the reset arm 84 to the operating position, and the pinch wheel 22 returns to its operating position (e.g., against the driven wheel 20 with the strap S between the wheels 20, 22). The infeed wheel motor 21 can then be actuated to convey or push the strap S through the guide 32 toward the feed head 12. The machine 10 can then enter a strapping cycle.

As strap S is pulled by the feed head 12, tension is drawn in the strap S. Because of the bend or turn 36 in the guide 32, the tensioned strap S exerts an upward force on the upper rail 38, which (slightly) pivots the upper rail 38 upward. This causes the link arm 74 and first finger 78 to move upward, so that the first finger 78, mounted to the link arm 74, contacts the second finger 80, mounted to the lower rail flange leg 48. This in turn pivots the lower rail 40 into the stowed position, and opens the guide 32 to the slack box accumulation region 42.

As the strapping cycle continues, strap S can be fed into the slack box 26 (the accumulation region 42), for example, during the retraction and/or tensioning portions of the cycle, or by the infeed assembly 28 from the dispenser 18. And, strap S can be drawn from the slack box 26 during normal/continued, strapping cycles, with strap being stored and/or drawn from the slack box 26.

When a misfeed occurs or when a new source of strap S is required (e.g., dispenser 18 or reel change out), strap S is fed from the dispenser 18 into the pre-feed assembly 28. The reset arm handle 86 is pulled up (which moves the lower rail 40 into the deployed position and urges the pinch wheel 22 away from the driven wheel 20).

Once strap S is manually fed into the pre-feed assembly 28, the reset handle 86 is released which allows the pinch wheel 22 to move toward the driven wheel 20 (by fore of the spring 96) with the strap therebetween. The infeed wheel motor 21 is actuated and the infeed wheel 20 feeds strap S through the guide 32 to the feed head 12. Once strap S reaches the feed head 12, the feed head 12 is actuated which pulls the strap S, drawing tension in the strap S. Again, once tension is drawn in the strap S, because of the bend or turn 36 in the guide 32, the upper rail 38 is pivoted upward, which in turn, pivots or moves the lower rail 40 into the stowed position, opening the guide 32 to the slack box accumulation region 42.

It will be appreciated by those skilled in the art that the relative directional terms such as upper, lower, rearward, forward and the like are for explanatory purposes only and are not intended to limit the scope of the disclosure.

All patents referred to herein, are hereby incorporated, herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A strap loading assembly for a strapping machine for feeding a strap material around a load, positioning, tensioning and sealing the strop material around the load, the strapping machine having a feed head for feeding the strapping material into the strapping machine, the strapping machine including a strap chute through which the strapping material is conveyed and a sealing head to seal overlapping courses of the strapping material to one another, the strapping machine including a strap pre-feed assembly and a slack box positioned at least in part between the strap pre-feed assembly and the feed head, the strap loading assembly comprising:

a movable first rail;

a second rail movable between a deployed position, and a stowed position, the second rail, when in the deployed position, confronting the first rail and defining a strap guide with the first rail, the second rail, when in the stowed position, opening the strap guide; and a link operably connecting the first rail and the second rail, wherein strap material in the strap guide, when in tension, exerts a force on the first rail to move the first rail and the link, the link moving the second rail from the deployed position to the stowed position.

2. The strap loading assembly of claim 1 wherein the first rail is pivotable between a deployed position and an actuating position to move the second rail from the deployed position to the stowed position.

3. The strap loading assembly of claim 1 wherein the second rail is pivotally movable between the deployed and stowed positions.

4. The strap loading assembly of claim 3 including two pivot pins at opposing ends of the second rail.

5. The strap loading assembly of claim 4 including a spring operably connected to the second rail to maintain the second rail in one or both of the deployed and stowed positions.

6. The strap loading assembly of claim 1 wherein the link is mounted to the first rail and includes a first finger, the first finger cooperating with a second finger mounted to the second rail to pivotally move the second rail from the deployed position to the stowed position.

7. The strap loading assembly of claim 1 including a reset link to move the second link from the stowed position to the deployed position.

8. The strap loading assembly of claim 2 including a stop to limit movement of the first rail to the actuating position.

9. The strap loading assembly of claim 2 including a stop to limit movement of the first rail to the deployed position.

10. The strap loading assembly of claim 7 wherein the reset link includes a handle to manually reset the second rail from the stowed position to the deployed position.

11. A strapping machine, comprising:

a feed head for feeding strapping material into the strapping machine, the feed head having a driven feed wheel and a pinch, feed wheel, a strap chute through which the strapping material is passed;

a sealing head to seal overlapping courses of the strapping material to one another;

a strap pre-feed assembly;

a stack box positioned at least in part between the strap pre-feed assembly and the feed head; and a strap loading assembly, the strap loading assembly including a movable first rail and a movable second rail, the second rail movable between, a deployed position and a stowed position, the second rail, when in the deployed position, confronting the first rail and defining a strap guide with the first rail; the second rail, when in the stowed position opening the strap guide to the slack box, the strap loading assembly including a link operably connecting the first rail and the second rail, wherein strap material in the strap guide, when in tension, exerts a force on the first rail to move the first rail and the link, the link moving the second rail from the deployed position to the stowed position.

12. The strapping machine of claim 11 wherein the link is mounted to the first rail, the first rail being pivotable between a deployed position and an actuating position, the link operably connected to the second rail to move the second rail from the deployed position to the stowed position.

13. The strapping machine of claim 11 wherein the second rail is pivotally movable between the deployed and stowed positions.

14. The strapping machine of claim 11, wherein the link is operably connected to the second rail by a pair of fingers, a first finger mounted to the link and a second finger mounted to the second rail.

15. The strapping machine of claim 11 including a reset link to move the second link from the stowed position to the deployed position.

16. The strapping machine of claim 12 including a stop to limit movement of the first rail to the actuating position.

17. The strapping machine of claim 11 including a stop to limit movement of the first rail to the deployed position.

18. The strapping machine of claim 15 wherein the reset link includes a handle to manually reset the second rail from the stowed position to the deployed position.

19. The strapping machine of claim 11 wherein strap loading assembly is located, at least in part, within the slack box.

* * * * *

UNITED STATES PATENT AND TRADEMARK OFFICE

CERTIFICATE OF CORRECTION

PATENT NO. : 8,689,684 B2
APPLICATION NO. : 13/623285
DATED : April 8, 2014
INVENTOR(S) : Haberstroh et al.

It is certified that error appears in the above-identified patent and that said Letters Patent is hereby corrected as shown below:

In the Specification

Column 1, line 25, “hum” to read as --from--.

Column 2, line 4, “strapping,” to read as --strapping--.

Column 2, line 5, “strapping,” to read as --strapping--.

Column 2, line 17, “loading,” to read as --loading--.

Column 2, line 45, “front” to read as --from--.

Column 2, line 47, “strapping,” to read as --strapping--.

Column 3, line 56, “loading,” to read as --loading--.

Column 3, line 64, “inked” to read as --infeed--.

Column 4, line 9, “inked” to read as --infeed--.

Column 4, line 17, “strapping,” to read as --strapping--.

Column 4, line 45, “fir” to read as --far--.

Column 5, line 4, “rail.” to read as --rail--.

Column 5, line 66, “inked” to read as --infeed--.

Column 6, line 21-22, “normal/continued,” to read as --normal/continued--.

Column 6, line 46, “incorporated,” to read as --incorporated--.

Signed and Sealed this
Twenty-seventh Day of January, 2015

Michelle K. Lee

Michelle K. Lee
*Deputy Director of the United States Patent and Trademark Office*

In the Claims

Column 6, line 64, Claim 1, “strop” to read as --strap--.

Column 7, line 7, Claim 1, “position,” to read as --position--.

Column 7, line 46, Claim 11, “pinch,” to read as --pinch--.

Column 8, line 6, Claim 11, “stack” to read as --slack--.

Column 8, line 10, Claim 11, “between,” to read as --between--.

Column 8, line 13, Claim 11, “rail;” to read as --rail,--.